United States Patent [19]

Marburger

[11] Patent Number: 4,585,057

[45] Date of Patent: Apr. 29, 1986

[54] COOLED TUBESHEET INLET FOR ABRASIVE FLUID HEAT EXCHANGER

[75] Inventor: David C. Marburger, Monroeville, Pa.

[73] Assignee: KRW Energy Systems Inc., Madison, Pa.

[21] Appl. No.: 432,034

[22] Filed: Sep. 30, 1982

[51] Int. Cl.[4] ..... F28F 19/00; F28F 9/04; F28F 9/22

[52] U.S. Cl. ..... 165/134.1; 165/158; 165/159

[58] Field of Search ..... 165/134 R, 178, DIG. 27, 165/158, 159, 173

[56] References Cited

U.S. PATENT DOCUMENTS

| | | | |
|---|---|---|---|
| 1,348,455 | 8/1920 | Spicer et al. | 165/160 |
| 1,995,768 | 3/1935 | Fesenmaier | 165/178 |
| 2,986,454 | 5/1961 | Jewett | 165/134 R |
| 3,374,832 | 3/1968 | Tucker | 165/134 R |
| 3,409,407 | 11/1968 | Loeffler et al. | 165/134 R |
| 3,416,598 | 12/1968 | Dorn | 165/134 R |
| 3,504,739 | 4/1970 | Pearce | 165/134 R |
| 3,610,329 | 10/1971 | Markert | 165/134 R |
| 3,702,633 | 11/1972 | Csathy | 165/159 |
| 4,097,544 | 6/1978 | Hengstebeck | 165/134 R |
| 4,103,738 | 8/1978 | Aydelott et al. | 165/178 |
| 4,173,615 | 11/1979 | Otsuka et al. | 165/134 R |
| 4,346,758 | 8/1982 | Kehrer et al. | 165/134 R |

FOREIGN PATENT DOCUMENTS

| | | | |
|---|---|---|---|
| 0258892 | 11/1910 | Fed. Rep. of Germany | 165/158 |
| 0063395 | 5/1980 | Japan | 165/134 R |
| 0016793 | 1/1982 | Japan | 165/158 |

*Primary Examiner*—William R. Cline
*Assistant Examiner*—John K. Ford

[57] ABSTRACT

This invention provides a heat exchanger for use with an abrasive fluid comprising an inlet plenum disposed within the heat exchanger for inletting an abrasive fluid into the heat exchanger, a tubesheet disposed within the heat exchanger and adjacent to the plenum, tubes disposed through the tubesheet and in flow communication with the plenum, a tube inlet guide configuration disposed between the tubesheet and the inlet plenum for guiding the abrasive fluid into the tubes, and a cooling means for cooling the tube inlet guide configuration. In a preferred form, the tube inlet guide configuration may be removable.

1 Claim, 2 Drawing Figures

COOLED TUBESHEET INLET FOR ABRASIVE FLUID HEAT EXCHANGER

BACKGROUND OF THE INVENTION

1. Field of the Invention

This invention relates to heat exchangers and more particularly to apparatus for cooling a fluid with abrasive and depositive characteristics.

2. Description of the Prior Art

In reactors for the gasification of carbonaceous materials such as coal, a combustible product gas is produced as well as solid waste products such as agglomerated ash. The untreated product gas from gasified coal is called raw gas and contains a significant amount of particles which are partially molten at the gasifier exit temperatures of approximately 1800° F. These particles, which are of varying chemical composition, will stick both to metallic and non-metallic surfaces regardless of the angle of incidence of the gas flow to the surface when the gas flows out of the gasifier exit. It has been demonstrated that eventually flow passages will plug almost closed with solidified material.

Present information in technical papers and from experimental data indicate the deposition of these molten particles as they exit from the gasifier will not occur if one of the three following conditions are maintained: (a) the raw gas temperature does not exceed 1300° F.; (b) the surfaces through which the raw gas passes or is allowed to impact are metallic and are maintained at less than 500° F. at the gas/metal interface; or (c) the raw gas velocity is kept very low.

It has also been observed that very high erosion rates result from the abrasive nature of the raw gas. At times, particle quantities on the order of 800 lbs/hr. have been seen in the raw gas of a coal gasification unit which is rated at approximately 2500 lbs. of coal input per hour. These particles range in size from 2 microns to 300 microns and typical velocities range between 25 feet per second and 35 feet per second.

Since some erosion is inevitable, it may be necessary to replace those surfaces which are most severely eroded. Replacement of the entire heat exchanger is feasible but costly, so replacement of a smaller part of the heat exchanger would be less expensive both from the standpoint of component cost and replacement time.

It is also necessary to protect the tubesheet from exposure to the elevated temperatures of the raw gas.

It is thus desirable to provide raw gas heat exchangers with tubesheet structures which will be resistant to particle sticking and thus less susceptible to plugging, will be resistant to erosion and when undesirably eroded, may be replaced relatively easily and which will provide cooling for the heat exchanger tubesheet.

SUMMARY OF THE INVENTION

This invention provides a heat exchanger for use with an abrasive fluid comprising a shell, an inlet plenum disposed within the shell, an inlet penetration for inletting an abrasive fluid into the heat exchanger, a tubesheet disposed within the heat exchanger and adjacent to the plenum, tubes disposed through the tubesheet and in flow communication with the plenum, a tube inlet guide configuration disposed between the tubesheet and the inlet plenum for guiding the abrasive fluid into the tubes, and a cooling means for cooling the tube inlet guide configuration and tubesheet. In a preferred form, the tube inlet guide configuration may be removable.

BRIEF DESCRIPTION OF THE DRAWINGS

The advatages, nature and additional features of the invention will become more apparent from the following description, taken in connection with the accompanying drawings in which.

DESCRIPTION OF THE PREFERRED EMBODIMENTS

Figure 1:
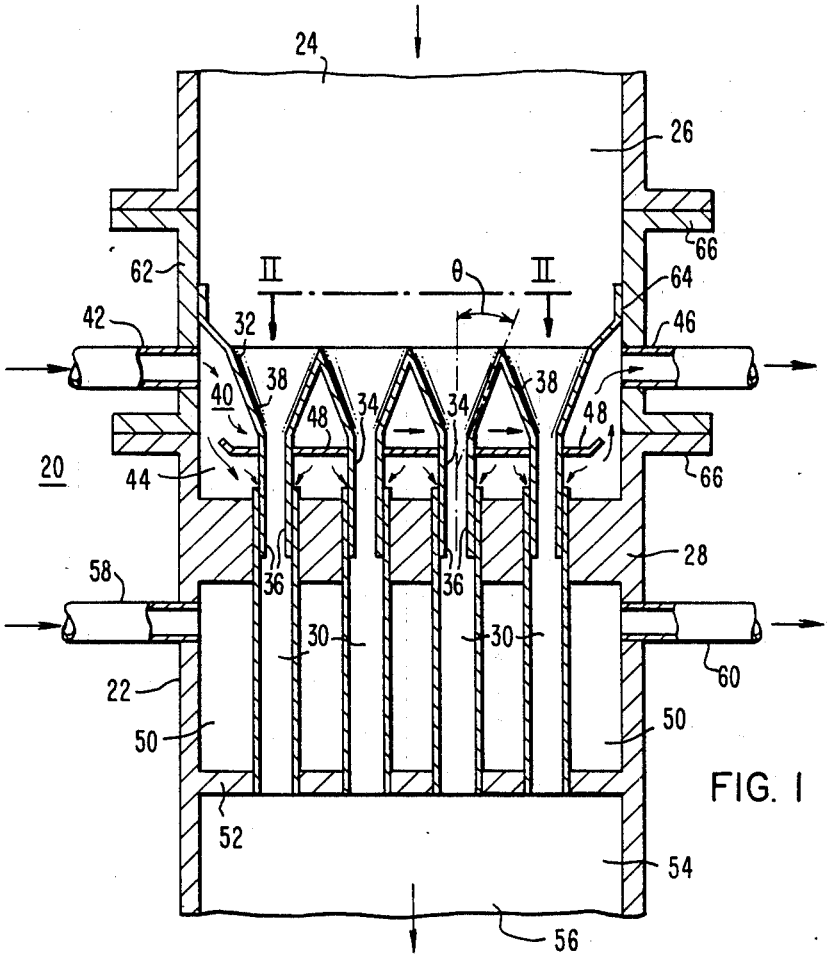
FIG. 1 is a sectional view of a portion of a heat exchanger made in accordance with the invention.

Referring now to FIG. 1, there is shown a heat exchanger 20 made in accordance with the invention. The heat exchanger 20 comprises a shell 22, an abrasive fluid (not shown) inlet 24 penetrating the top of the shell 22, an inlet plenum 26 disposed within and at the top of the shell 22, an upper tubesheet 28 disposed within the shell 22 adjacent to the inlet plenum 26, tubes 30 extending through the upper tubesheet 28 and in fluid communication with the inlet plenum 26 and a tube inlet guide configuration 32 disposed between the upper tubesheet 28 and the inlet plenum. The tube inlet guide configuration 32 comprises a series of funnel shaped tubular extensions 34 with lower ends 36 and upper ends 38 and may be of any erosion resistant material, such as metal or refractory ceramic or steel coated with erosion resistant facing. The lower ends 36 are disposed within the tubes 30 and extend downwardly below the upper tubesheet 28, and the upper ends 38 are flared outwardly against the upper ends 38 of adjacent tubular extensions 34, and preferably welded, brazed or otherwise sealingly attached to form a gas-tight barrier. The invention further comprises a cooling means for the guide configuration, which in the preferred embodiment includes a cooling system 40 comprising a cooling fluid inlet penetration 42 in the side of the shell 22, a cooling fluid passageway 44 disposed between the tube inlet guide configuration 32 and the upper tubesheet 28 and in flow communication with the cooling fluid inlet penetration 42, and a cooling fluid outlet penetration 46 in fluid communication with the cooling fluid passageway 44. Disposed within the cooling fluid passageway 44 may be a baffle 48.

Figure 2:
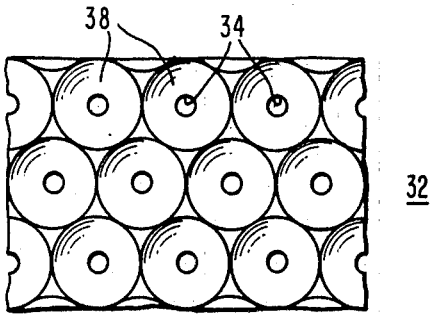
FIG. 2 is a partial sectional view taken on line II—II of FIG. 1.

Looking now at FIG. 2, there is shown a partial sectional view of the tube inlet guide configuration 32 looking downwardly. As can be seen, there is a minimum of surface area which is perpendicular to the axis of the tubes 30.

Referring again to FIG.1, the tubes 30 pass through a heat exchanger plenum 50 adjacent to and below the upper tubesheet 28, thence through a lower tubesheet 52 which is adjacent to and below the heat exchange plenum 50. An outlet plenum 54 is adjacent to and below the lower tubesheet 52. The inlet plenum 26 is in flow communication with the outlet plenum 54 by way of the tubes 30. An abrasive fluid outlet 56 penetrates the bottom of the shell 22. A heat removal fluid influent nozzle 58 and a heat removal fluid effluent nozzle 60 penetrate the shell 22 between the upper tubesheet 28 and the lower tubesheet 52.

In the preferred form, the tube inlet guide configuration 32 is attached to a removable shell section or spool piece 62. The attachment may be by a weld means at a joint 64. The removable shell section 62 is secured to the shell 22 at flanges 66, which may be held together by weld means or bolt means.

The heat exchanger operates in the following manner. Referring to FIG. 1, an abrasive fluid, such as raw gas from a carbonaceous material gasifier, enters the heat exchanger 20 through the abrasive fluid inlet 24 into the inlet plenum 26 and towards the tube inlet guide configuration 32. The flare of the tubular extension upper ends 38 act to guide the raw gas into the tubes 30 and past the upper tubesheet 28. A cooling fluid, which may be raw gas which has been cooled and cleansed of particulate material, enters the cooling fluid inlet penetration 42, passes through the cooling fluid passageway 44 and exits through the cooling fluid outlet penetration 46. During the time the cooling fluid is within the cooling fluid passageway 44, part of the cooling fluid cools the tubular extension upper ends 38 and part of the cooling fluid cools the upper tubesheet 28. An additional amount of cooling fluid may escape between the tubular extension lower ends 36 and the tubes 30, which may not be a leak-tight seal.

The angle $\theta$ of the flare of the tubular extension upper ends 38 away from the vertical axis of the tubes 30 may be between 20° and 40°. The optimum angle $\theta$ is one which will provide the smallest amount of surface area which is perpendicular to the raw gas flow while at the same time providing for a change in direction of the raw gas into the tubes 30 which is as small a rate of change of direction as possible.

In the preferred embodiment, the entire tube inlet guide configuration 32 will be attached to a removable shell section 62 of the shell 22 which can be easily removed. In this preferred form, the tubular extensions 34 will not be attached to the tubes 30 but only fit snugly enough to allow leakage of the cooling fluid into the tubes 30. This results in additional cooling of the upper tubesheet 28.

I claim:

1. An abrasion resistant vertical shell and tube heat exhanger for cooling hot abrasive gases on the tube side which comprises:

a cylindrical shell;

an upper tubesheet joined to said cylindrical shell;

a plurality of circular tubes joined to and terminating at said upper tubesheet;

a cylindrical spool piece having a diameter substantially the same as that of said cylindrical shell, a cooling fluid inlet and a cooling fluid outlet, said spool piece being removably joined to said shell proximate said upper tubesheet;

a corresponding plurality of circular tubular extensions disposed at least partially within said spool piece having lower ends slidably disposed within said tubes proximate said upper tubesheet, said extensions circularly flared at the upper ends at an angle between 20 and 40 degrees with respect to the axis of said circular tubular extensions, each of the upper circularly flared ends being joined directly to adjacent circularly upper flared ends at the top extremities thereof and the circularly upper flared ends adjacent to the spool piece being joined to the spool piece above said cooling fluid inlet and outlet, said tubular extensions being made of a abrasion-resistant material selected from metal, refractory ceramic and steel coated with an erosion-resistant facing; and a cooling fluid passageway defined by the inner surface of said spool piece, the outer surfaces of said plurality of tube extensions and the upper surface of said upper tubesheet.

* * * * *